United States Patent [19]

MacKay, Jr.

[11] Patent Number: 4,754,577

[45] Date of Patent: Jul. 5, 1988

[54] DISPOSABLE FINISHING ARTICLE HAVING AN INTEGRAL MOUNTING HUB INCLUDING IMPROVED PRESSURE CAP

[76] Inventor: Joseph H. MacKay, Jr., 17551 Cabela Dr., San Diego, Calif. 92127

[21] Appl. No.: 113,937

[22] Filed: Oct. 27, 1987

Related U.S. Application Data

[63] Continuation-in-part of Ser. No. 5,813, Jan. 21, 1987, which is a continuation-in-part of Ser. No. 847,793, Apr. 3, 1986, Pat. No. 4,694,615.

[51] Int. Cl.[4] ..... B24B 45/00

[52] U.S. Cl. ..... 51/168; 51/209 R; 51/378; 15/230.18

[58] Field of Search ..... 51/168, 209 R, 358, 51/376, 377, 378, 389; 15/230.18, 230.19

[56] References Cited

U.S. PATENT DOCUMENTS

| | | | |
|---|---|---|---|
| 489,149 | 1/1893 | Hyde | 51/168 |
| 872,932 | 12/1907 | Hall | 51/168 |
| 2,278,301 | 3/1942 | Bauer | 51/209 R |
| 2,633,008 | 3/1953 | Tocci-Guilbert | 51/168 X |
| 3,136,100 | 6/1964 | Robertson | 51/209 R |
| 3,623,281 | 11/1971 | Moffat | 51/377 |
| 3,879,178 | 4/1975 | Bosma | 51/168 |
| 4,015,371 | 4/1977 | Grayston | 51/168 |
| 4,322,920 | 4/1982 | Wells | 51/376 X |
| 4,439,953 | 4/1984 | Block et al. | 51/389 |
| 4,449,329 | 5/1984 | Sauerwein et al. | 51/168 |

*Primary Examiner*—Robert P. Olszewski

*Attorney, Agent, or Firm*—Nilsson, Robbins, Dalgarn, Berliner, Carson & Wurst

[57] ABSTRACT

A disposable finishing article for mounting on a rotatable threaded spindle of a power tool. The finishing article contains a retaining nut on one side and a backing flange on the other non-removably secured together on the finishing article without the aid of adhesives in such a manner that the finishing article is placed in compression when it is operably secured upon the spindle of the power tool under operative loads. The nut and flange are secured together by upsetting one end of the nut causing it to protrude outwardly over the outer surface of the flange. A pressure cap member is secured to a plurality of fingers formed on the backing flange for engaging a shoulder formed on the spindle of the power tool during operation of the finishing article.

10 Claims, 3 Drawing Sheets

DISPOSABLE FINISHING ARTICLE HAVING AN INTEGRAL MOUNTING HUB INCLUDING IMPROVED PRESSURE CAP

RELATED APPLICATION

This application is a continuation-in-part of U.S. patent application Ser. No. 005,813 filed Jan. 21, 1987 for DISPOSABLE DEPRESSED CENTER GRINDING WHEEL HAVING AN INTEGRAL MOUNTING HUB INCLUDING A PRESSURE CAP which is a continuation-in-part of Ser. No. 847,793, filed Apr. 3, 1986 for DISPOSABLE DEPRESSED CENTER GRINDING WHEEL HAVING AN INTEGRAL MOUNTING HUB, now U.S. Pat. No. 4,694,615.

FIELD OF THE INVENTION

This invention relates generally to finishing articles and more particularly to such articles having a mounting hub permanently affixed thereto with the combination adapted for quick attachment and release to an appropriate portable power tool.

BACKGROUND OF THE INVENTION

The use of rotatably driven finishing articles is widespread and familiar in our industrial society. One of the more serious problems encountered in the use of such devices resides in the provision of effective means for preventing undesired or accidental disassociation of the article from the shaft, spindle or other rotatable drive means on which it is mounted. This problem is particularly acute when the connection between the article and its driving shaft or spindle is intentionally detachable to facilitate quick removal and replacement of the article. Into this category fall a host of devices, for example, portable powered grinders wherein the grinding wheels employed are intentionally detachable from the power driven shaft so that they may be readily replaced. To properly mount the grinding wheel upon the shaft provision must be made to provide sufficient clamping force and also to secure the wheel rotationally.

One means of securing the grinding wheel to the drive shaft has been to provide an appropriate backing flange with a central opening which is aligned with an opening provided in the depressed center abrasive grinding wheel. A bolt or nut member (depending upon the configuration of the drive shaft, that is, whether it is externally or internally threaded) is inserted from the face side of the grinding wheel and is then tightened in place. In this manner a plurality of loose parts are configured in a completed assembly ready for use. As the grinding wheel is utilized the appropriate clamping force is provided to securely affix the grinding wheel to the drive shaft. Such an assembly, however, typically requires appropriate tools such as wrenches or the like to remove the grinding wheel from the drive shaft. Such a device is shown in U.S. Pat. Nos. 489,149; 3,596,415; 1,998,919; 566,883; 507,223; 1,162,970; 791,159; 489,149 and 3,210,892.

Subsequently it became desirable to affix the mounting hub permanently to the grinding wheel so that the entire unit may be quickly and easily attached and detached from the drive shaft and discarded when the grinding wheel has been worn down. In these types of devices it is customary to utilize an adhesive such as an epoxy resin or the like between the backing flange and the back surface of the grinding wheel to retain integrity between the mounting hub and the grinding wheel to secure the wheel rotationally.

Even though the adhesive tended to work quite well in most applications, it was discovered that in some instances the adhesive would break loose and the grinding wheel would rotate relative to the mounting hub. Such was particularly the case since the hub was a one-piece member which was internally threaded and held in place upon the grinding wheel by swaging an extension thereof into place, thus providing a fixed clamping force holding the grinding wheel. No additional clamping force was exerted during further rotation of the wheel during use as was the case with the traditional nut which was secured from the face as above described. As a result various keyways and corresponding key structures were developed between the wheel and the mounting hub and used in conjunction with the adhesive to preclude rotational movement between the mounting hub and the grinding wheel. Examples of such devices are shown in U.S. Pat. Nos. 3,136,100; 4,015,371; 2,278,301; 3,081,584; 3,500,592; 3,800,483; 4,240,230 and 4,541,205.

Additional prior art patents known to applicant are U.S. Pat. Nos. 3,041,797; 3,879,178; 1,724,742; 3,912,411; 3,879,178; 3,960,516; 4,026,074; 4,054,425; 4,088,729; 4,322,920; 4,439,953; 4,449,329; 4,601,661; 791,791; 872,932; 2,567,782; 3,136,100, 3,210,892 and 3,621,621.

The devices utilized in the prior art for providing the disposable finishing article assembly including the permanent affixed mounting hub generally provide the service intended. There are certain inherent disadvantages found with regard to the various devices. Such disadvantages are that in manufacturing the utilization of an adhesive adds additional labor to the cost of manufacturing. In certain of the devices, parts must be keyed together and properly aligned in order to function appropriately. In addition thereto, through the utilization of die-cast mounting hubs which include as an integral part the backing flange there is no additional clamping force exerted upon the finishing article as it is being rotated by the power tool. Furthermore, such die-cast mounting hubs are relatively bulky, take up space and add substantial weight and additional cost to the completed product.

SUMMARY OF THE INVENTION

A finishing article having a drive member non-removably affixed thereto for mounting on a rotatable spindle of a power tool. The drive member includes a backing flange having gripping means radially extending therefrom secured by a retaining nut positioned on the opposite side from the backing flange. The retaining nut extends through an opening in the finishing article from the face toward the back of the finishing article and has a radial flange at one end thereof seated against the finishing article face and protrusion means extending outwardly from the other end thereof for non-removably securing the retaining nut and the backing flange together on the finishing article without the use of adhesives. A pressure cap defining a central opening is held in place by the gripping means on the backing flange and extends longitudinally away from the backing flange to engage the power tool spindle seat for placing the abrasive finishing article in compression during use thereof when the finishing article is operatively secured upon the spindle of the power tool.

DETAILED DESCRIPTION

Figure 1:
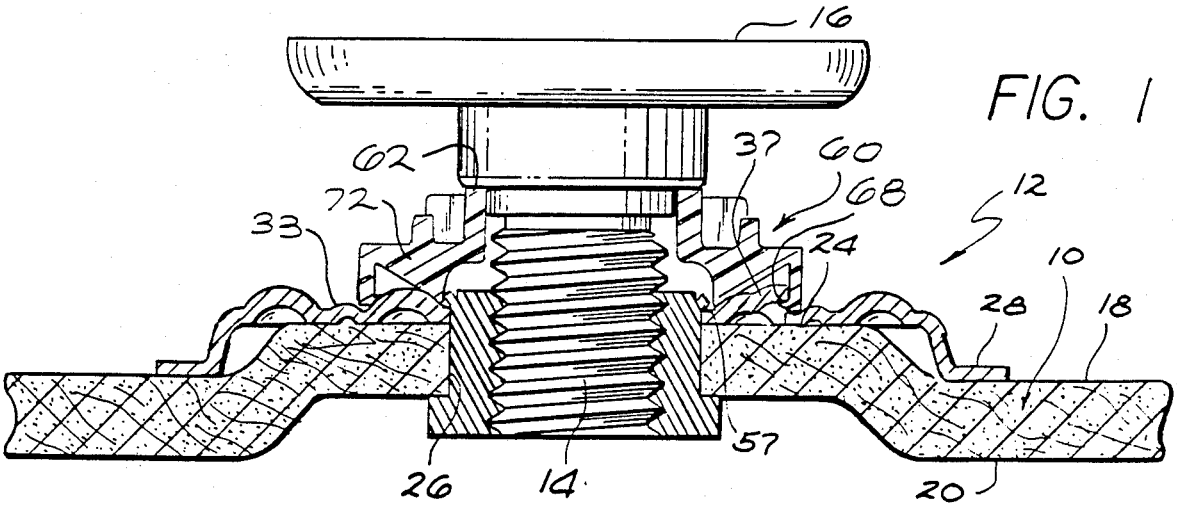
FIG. 1 is a cross sectional view of a finishing article assembly constructed in accordance with the principles of the present invention and mounted in operable position on the spindle of a power tool.

By reference now to FIGS. 1 through 6, there is illustrated a preferred embodiment of a disposable finishing article drive member assembly constructed in accordance with the principles of the present invention. The finishing article constructed in accordance with the present invention may take many forms, such, for example, as grinding wheels, flap wheels, wire wheels, abrasive disks or pads, or the like. For purposes of ease of illustration and clarity of description only a depressed center grinding wheel will be shown and described. It will, however, be understood by those skilled in the art that other disposable finishing articles which may be placed in compression during use thereof may be substituted for the grinding wheel. As is shown in FIGS. 1 through 6, a depressed center grinding wheel 10 has a disposable drive member or hub assembly 12 permanently affixed thereto without the use of adhesives so that the grinding wheel may be attached to the threaded spindle 14 of an appropriate power tool 16. According to the principles of the present invention, a disposable mounting hub or drive member is constructed in such a manner that when the grinding wheel is placed in operation upon the spindle 14 the grinding wheel 10 is placed in compression and the more force that is applied to the grinding wheel during utilization thereof, the greater the operational compression becomes. As a result of placing the grinding wheel in such compression the grinding wheel is maintained upon the spindle and at the same time, through the compression or clamping force, the grinding wheel 10 cannot rotate relative to the drive member or hub assembly 12. However, as a result of the construction of the drive member, the spent grinding wheel may be easily removed from the spindle for disposal without the utilization of hand tools or the like.

As is clearly shown, the grinding wheel 10 includes a back surface 18 and a front surface 20. The central portion of the grinding wheel is depressed as viewed from the front thereof and as is shown at 22, with a corresponding central raised portion 24 on the back thereof. A centrally located aperture 26 is provided in the depressed center portion of the grinding wheel 10. The purpose of the depressed center of the grinding wheel 10 is to insure that the driving member or spindle does not protrude beyond the face portion 20 of the wheel 10 and thus interfere with a workpiece during the time the grinding wheel 10 is being utilized. However, when certain types of finishing articles are utilized such that the outer circumference is used instead of the face, then a depressed center may not be necessary or included in the article.

A backing flange 28 is provided and is adapted to be snugly received on the back surface 18 of the grinding wheel 10 about the raised portion 24. The flange 28 has a diameter which is less than the diameter of the wheel 10. The backing flange 28 defines a second central aperture 30 therethrough which is aligned with the aperture 26 in the grinding wheel 10. Reinforcing ribs 32, 33 and 34 are formed in the backing flange 28 concentrically with the opening 30. The backing flange 28 is preferably stamped from sheet metal but of course could be constructed from other materials such as hard molded plastic or die cast metal should such be desired.

Figure 3:
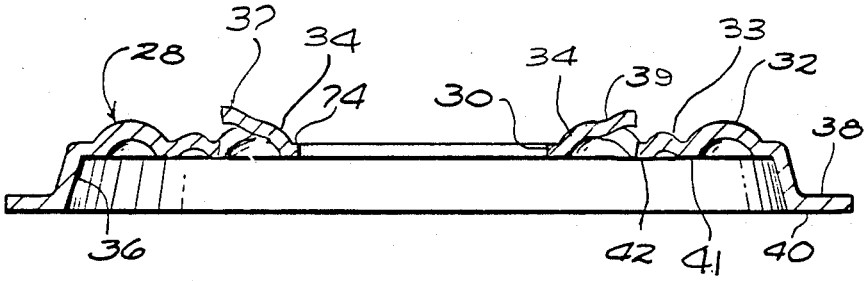
FIG. 3 is a cross sectional view taken about the lines 3—3 in FIG. 2 of a backing flange constructed in accordance with the present invention.

As is shown more specifically in FIG. 3, the backing flange 28 includes an inner surface 36 and an outer surface 38. The inner surface 36 is disposed opposed the back surface 18 of the abrasive finishing wheel 10. The inner surface 36 includes lands 40, 41 and 42. The land 40 is formed about the outer peripheral portion of the backing flange 28. The lands 41 and 42 are displaced inwardly toward the opening 30 and away from the land 40. The land 40 always engages the back surface 18 of the abrasive finishing wheel away from the depressed center while the lands 41 and 42 may engage the back surface of the abrasive finishing wheel 10 opposed the depressed center 22 thereof depending upon variations in wheel dimensions and manufacturing tolerances in the wheels and flanges.

As can be seen, particularly in FIG. 3, the ribs 32, 33 and 34 formed in the outer surface 38 of the backing flange 22 are continuous. The continuous rib 32 is disposed between the lands 41 and 42 and over the transitional area between the depressed center and the remainder of the grinding wheel 10 while the continuous rib 33 and 33 are disposed intermediate the opening 30 and the land 42. The continuous rib 34 has gripping means such as a plurality of radially outwardly extending fingers 35, 37 and 39 formed therein. Preferably, when the backing flange 28 is fabricated from stamped sheet metal the fingers 35, 37 and 39 may be formed by cutting or punching the sheet metal during the stamping operation. Obviously if the backing flange is formed of molded plastic or metal, then the gripping means may take other forms and would be fabricated preferably during molding of the backing flange. The purpose and function of the gripping means will be described herein after.

Figure 4:
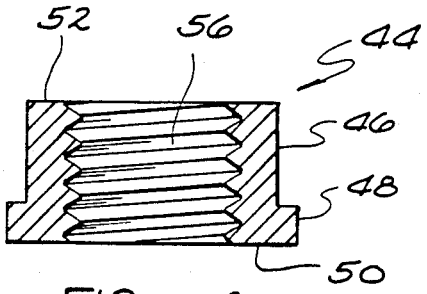
FIG. 4 is a cross sectional view of a retaining nut constructed in accordance with the principles of the present invention.

As shown in FIG. 4, a retainer nut 44 includes a body portion 46 which is hollow and has a radially outwardly extending flange 48 at a first end 50 thereof. The internal surface of the body 46 has threads 56 formed therealong for attachment to the threaded spindle 14 of the power tool. The nut 44 is inserted through the aperture 26 in the grinding wheel and the aperture 30 in the flange 28 from the front surface 20 toward the rear surface 18 of the grinding wheel 10. The end 52 of the nut 44 extends through the opening 30 in the flange 28.

The nut 44 is preferably constructed from an aluminum extrusion which is then machined to provide the flange 38 and the threads 46. Alternatively the nut may be formed from aluminum or steel bar stock, or a metal die casting, or molded plastic.

Figure 5:
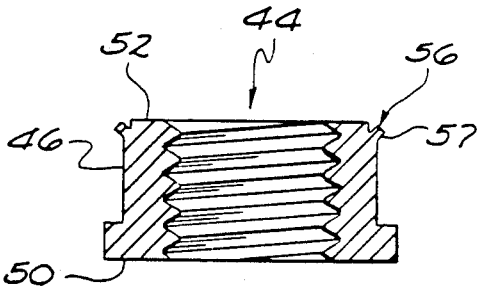
FIG. 5 is a cross sectional view of the retaining nut of FIG. 5 after being upset.
Figure 2:
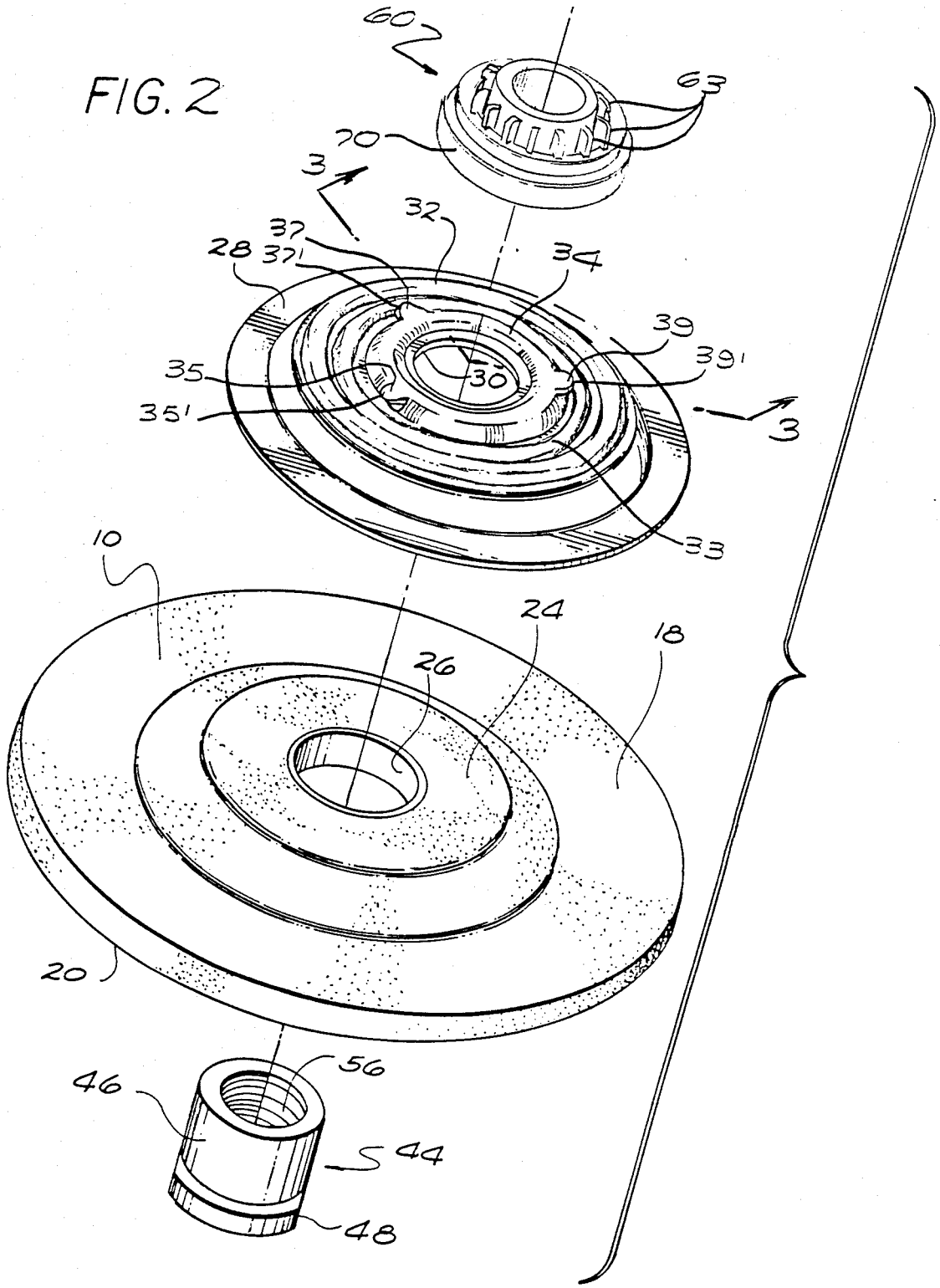
FIG. 2 is an exploded view of the structure as illustrated in FIG. 1.
Figure 6:
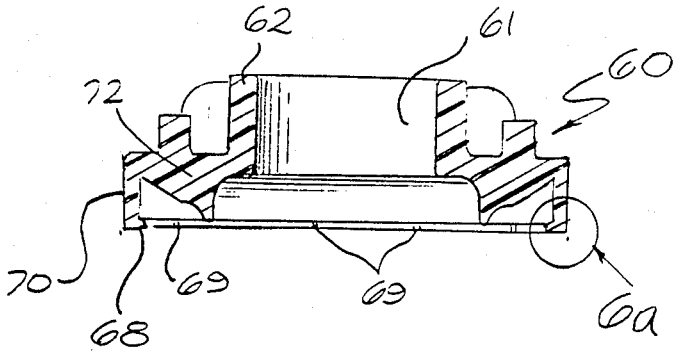
FIGS. 6 and 6*a* are a cross sectional view and fragmentary cross sectional view respectively showing construction of a pressure cap constructed in accordance with the present invention.
Figure 6A:
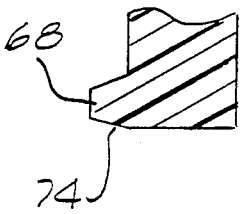

Once the nut 44 has been inserted through the openings in the wheel 10 and the flange 28, the end 52 thereof is upset such as by a staking operation to provide a protrusion 56 extending outwardly therefrom as shown specifically in FIG. 5. The protrusion may be formed as a series of separate protrusions, or, as shown, as a continuous protrusion. Preferably the protrusion is formed by staking operation which forms a continuous groove 54 in the end of 52 of the nut 44. Formation of the groove 54 causes the displaced material to form a lip or overhang 57 which will overlie the back of the backing flange 28 about the opening 30 therethrough. It should become apparent to those skilled in the art that the flange 28 and the nut 44 are secured together on the wheel 10 between the flange 48 and the overhang 57 without the use of adhesives.

To provide proper operational compressive forces of the throwaway grinding wheel as above-described, a pressure cap 60 is snapped into locking engagement with the hub assembly 12. The pressure cap includes a first or rear surface 62 for engaging a surface 64 on the power tool spindle when the grinding wheel is in an operable position on the power tool 16. A second or front surface 66 on the pressure cap 60 contacts the top of the continuous rib 34. The pressure cap 60 is retained in position on the hub assembly 12 by a gripping rib 68 which extends radially inwardly from a downwardly depending skirt 70 on the body 72 of the pressure cap 60. The gripping rib 68 snaps over the digital ends 35, 37 and 39 of the fingers 35, 37 and 39 respectively as is more clearly shown in FIG. 1. The gripping rib 68 includes an upwardly sloping surface 74 which allows easy assembly of the cap 60 on the flange 28. The body 72 of the pressure cap 60 defines an aperture 61 for receiving the spindle 14 of the power tool. When assembled on the backing flange 28 the apertures 26, 30 and 61 are aligned axially. As is more clearly shown in FIG. 2 the pressure cap includes a plurality of stiffening ribs 63 formed integrally therewith disposed between the surfaces 62 and 66. As will be noted, when the grinding wheel is in use on the power tool compressive forces are transmitted through the body 72 of the pressure cap 60 between the surfaces 62 and 66. The bulk of the body 72 betWeen surfaces 62 and 66 and the stiffening ribs 63 carry these forces. Preferably the pressure cap 60 is constructed of molded plastic such as polypropylene, nylon, acetal or the like. The gripping rib 68 may be continuous or intermittent as desired as illustrated by the lines 69. An important feature is that the pressure cap may be easily snapped into locking position as shown in FIG. 1 by the distributor or user before use if desired or, alternatively, at the time of assembly in the factory. Such capability saves space in shipment in that the assembled wheel without the pressure cap may be packed in containers with pressure caps placed in interstices between wheels or wheels and the container. Thus a greater number of wheels may be packaged, on top of each other, in the same container.

The pressure cap 60, once installed, remains on the grinding wheel and is disposed of along with the spent wheel. Through utilization of the gripping rib 68 and fingers 35, 37 and 39 it is surprisingly easy to assemble the pressure cap 60 with backing flange 28 and surprisingly difficult to remove the pressure cap 60 once it is snapped into place. Such removal, if desired, can only be accomplished with the use of a tool to pry the cap 60 loose.

Figure 7:
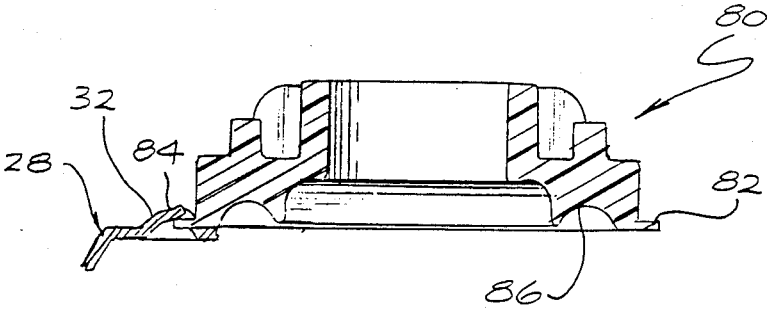
FIG. 7 is a cross sectional view showing construction of an alternative embodiment of a pressure cap attached to a backing flange and constructed in accordance with the present invention.

The force necessary to cause the grinding wheel 10 to be placed in compression is generated upon attachment of the spindle 14 to the threads 56 in the nut 44. By reference to FIG. 1 it will be noted that when the grinding wheel is threaded upon the spindle 14 the surface 62 engages the spindle seat 64. The interengagement between the threads 14 and 56 of the spindle and nut, respectively, urge the nut upward toward the flange 28 as the wheel is seated upon the spindle. At the same time, the spindle seat 64 applies a downward force to surface 62 of the pressure cap 60 which in turn, through the surface 66 applies a downward force to the flange 28. Therefore, this mutual clamping force causes the grinding wheel to be placed in compression. Those skilled in the art will recognize that as the grinding wheel 10 is used by being placed against a workpiece, additional torque is applied causing the grinding wheel to be further tightened onto the spindle 14. That is, as the grinding wheel moves during contact with a workpiece, the friction between the nut and the grinding wheel center causes the nut to rotate in a further tightening direction. Such rotation of the nut further urges the nut toward the flange which in turn applies a further force to the flange. The more the grinding wheel is tightened the greater the operational compression force becomes and the more securely the grinding wheel 10 is clamped between the backing flange 28 and the flange 48 on the nut 44. As a result of this strong clamping or compression the grinding wheel 10 is precluded from movement relative to the hub or driving member 12 and at the same time is precluded from disengaging from the spindle 14. Referring now more specifically to FIG. 7, there is illustrated an alternative embodiment of a pressure cap constructed in accordance with the teachings of the present invention. As is therein shown, the pressure cap 80 includes a radially outwardly directed gripping rib 82. The gripping rib 82 snaps into engagement with a plurality of radially inwardly directed fingers 34 formed in the continuous reinforcing rib 32 of the backing flange 28. A surface 86 contacts the rib 84 (which would not have the finger 35, 37 and 39) to assist in placing the finishing article in compression as above described.

It will be recognized by those skilled in the art that the grinding wheel assemblies as illustrated in FIGS. 1 through 7 and as above described require no adhesive for construction and may be simply and easily assembled, are relatively light in weight as compared to the prior art devices utilizing the cast hubs and provides a secure attachment of the abrasive finishing article to the power tool and through the utilization of the increased compression precludes relative rotation of the grinding wheel with respect to the driving member. It has also been discovered that the utilization of the device as above described and as constructed in the preferred embodiment is extremely smooth in operation with no vibration. The reason for such extremely smooth operation is that all of the parts are perfectly aligned one with the other with the abutting surfaces parallel when in compression and only the wheel 10 can cause any vibration and then only if it is not properly balanced during the construction thereof.

Through the structures as illustrated and described, all currently known sizes of standard diameter depressed center grinding wheels, namely four inch, four and one half inch, five inch, seven inch and nine inch may be accommodated. At the present time, through the utilization of the die-cast integral hub-flange structure, only seven and nine inch grinding wheels utilize the throw away hub while the four, four and one half and five inch wheel utilize the conventional two-piece mounting set traditional in the prior art and as above described.

There has thus been disclosed a disposable finishing article driving member assembly which securely holds the article during operation, which is light in weight, vibration-free, and less expensive than prior art throw-away articles while meeting all safety standards currently known and in existence.

What is claimed is:

1. A finishing article having a disposable drive member non-removably affixed thereto for mounting on a threaded rotatable spindle of a power tool comprising:

a finishing article having a face and a back and having a first centrally disposed aperture therethrough;

a backing flange having an inner and outer surface and diameter smaller than the diameter of said finishing article with said inner surface seated on said back of said article; said backing flange defining a second centrally disposed aperture therethrough, and gripping means extending radially from said outer surface thereof; said first and second apertures being aligned;

a retaining nut having a hollow internally threaded body having first and second ends and a first radially outwardly extending flange extending from said first end of said body, said body extending through said first and second apertures from said face toward said back with said radial flange seated against said face; and means protruding outwardly from said second end of said body to non-removably secure said retaining nut and said backing flange together on said wheel without the use of adhesives; and pressure cap means defining a centrally disposed opening therethrough secured to said gripping means extending radially from said backing flange to apply force to said backing flange when said finishing article is secured on said spindle to cause said backing flange and said retaining nut to move toward each other to compress said finishing article therebetween as operative loads are applied to said article during use on said power tool.

2. A finishing article as defined in claim 1 wherein said gripping means includes a plurality of radially extending fingers.

3. A finishing article as defined in claim 2 wherein said pressure cap means further includes a gripping rib engaging said fingers.

4. A finishing article as defined in claim 3 wherein said fingers are radially outwardly extending and said gripping rib is radially inwardly extending.

5. A finishing article as defined in claim 3 wherein said fingers are radially inwardly extending and said gripping rib is radially outwardly extending.

6. A finishing article as defined in claim 3 wherein said gripping rib is continuous.

7. A finishing article as defined in claim 3 wherein said gripping rib is discontinuous.

8. A finishing article as defined in claim 3 wherein said pressure cap further includes a cap body having a downwardly depending skirt terminating in said gripping rib.

9. A finishing article as defined in claim 8 wherein said cap body includes a first surface for engaging said spindle and a second surface for engaging said backing flange when said pressure cap is secured to said wheel.

10. A finishing article as defined in claim 9 wherein said outer surface of said backing flange includes a reinforcing rib extending therefrom and wherein said second surface engages said reinforcing rib.

* * * * *